US007740567B2

(12) United States Patent
Bailar

(10) Patent No.: US 7,740,567 B2
(45) Date of Patent: Jun. 22, 2010

(54) SHOE ACCESSORY

(76) Inventor: Benjamin Bailar, 3515 W. Allegheny Ave., 2nd Floor, Philadelphia, PA (US) 19132

( * ) Notice: Subject to any disclaimer, the term of this patent is extended or adjusted under 35 U.S.C. 154(b) by 0 days.

(21) Appl. No.: 12/486,250

(22) Filed: Jun. 17, 2009

(65) Prior Publication Data

US 2009/0241381 A1 Oct. 1, 2009

Related U.S. Application Data

(63) Continuation-in-part of application No. 11/019,886, filed on Dec. 22, 2004.

(60) Provisional application No. 60/532,050, filed on Dec. 22, 2003.

(51) Int. Cl.
*A63B 21/00* (2006.01)

(52) U.S. Cl. ..... 482/79; 482/80; 36/140

(58) Field of Classification Search ..... 482/79, 482/80, 148; 36/140, 92, 88, 91; 601/30
See application file for complete search history.

(56) References Cited

U.S. PATENT DOCUMENTS

| | | | | |
|---|---|---|---|---|
| 1,021,142 | A | 3/1912 | Freeman | |
| 1,386,028 | A | 8/1921 | Roe | |
| 1,487,390 | A | 3/1924 | King | |
| 1,954,569 | A | 4/1934 | League | |
| 2,484,389 | A | 10/1949 | Schatz | |
| 2,661,547 | A | 12/1953 | Hyde et al. | |
| 5,722,919 | A | 3/1998 | Timmer | |
| 6,277,057 | B1 | 8/2001 | Hayden | |
| 6,341,432 | B1 | 1/2002 | Muller | |
| 6,349,487 | B1 * | 2/2002 | Hice | 36/140 |
| 6,421,935 | B1 | 7/2002 | Bartlett | |
| 6,782,639 | B1 | 8/2004 | Muller | |
| 2002/0026730 | A1 | 3/2002 | Whatley | |
| 2005/0055849 | A1 | 3/2005 | Ha | |

OTHER PUBLICATIONS

The Gym Ball Store. Rocker boards for Balance Training and Core Stability Exercise, [online], [retrieved on Nov. 10, 2004]. Retrieved from the Internet<URL:http://gymball.com/rocker_boards.html>.
Welcome to TherapyZone. Rocker board, [online], [retrieved on Nov. 10, 2004]. Retrieved from the Internet<URL: http://therapyzone.com/tz.asp?wci=catitem&addToCart=&ID=74000_03_00>.
"What is EasyTone?", Reebok web page, retrieved from the Internet on Oct. 28, 2009 <URL:http://www.reebok.com/US/>.
"Skechers Shape-Ups Black Men's Shape-UPs Shoe," retrieved from the Internet on Oct. 28, 2009, pp. 1-3, <URL:http://www.shoes.com/Shopping/productdetails.aspx?catalog%5Fname=web&pg=5103085&p=E . . .>.

* cited by examiner

*Primary Examiner*—Jerome Donnelly
(74) *Attorney, Agent, or Firm*—Saul Ewing LLP

(57) ABSTRACT

The shoe accessory includes a platform for supporting a conventional shoe. The shoe accessory's base has a convex or other non-planar surface that causes the shoe accessory to be stable in a longitudinal (heel-toe) direction, and unstable in a lateral (medial/lateral) direction. The non-planar surface may be defined by a ridge segment on the platform's bottom side. One or more straps are provided to temporarily secure the wearer's conventional shoe to the platform in a non-destructive manner. A generally U-shaped heel retainer may be provided adjacent a rear portion of the platform for receiving the heel of the shoe. The shoe accessory makes a flat-soled shoe laterally unstable while allowing for longitudinal stability and a naturalistic gait, and thus facilitates exercise of leg and foot muscles during normal walking, etc.

14 Claims, 11 Drawing Sheets

SHOE ACCESSORY

CROSS-REFERENCE TO RELATED APPLICATION

This application is a continuation-in-part of U.S. patent application Ser. No. 11/019,886, which claims the benefit of U.S. Provisional Patent Application No. 60/532,050, filed Dec. 22, 2003, the entire disclosures of both of which are hereby incorporated herein by reference.

FIELD OF THE INVENTION

The present invention relates generally to the field of physical rehabilitation, and more particularly to a shoe accessory for facilitating rehabilitation of an injured ankle and/or the surrounding musculature of the leg and foot.

DISCUSSION OF RELATED ART

Various types of devices are promoted as aids in ankle injury rehabilitation. One type of device used for this purpose is a foot-supporting platform that is connected to a base via one or more supports. The supports allow movement of the platform while also providing resistance to its movement. One such device is shown in U.S. Pat. No. 6,277,057. Consequently, manipulation of the platform exercises the ankle, and associated foot/leg musculature, thereby aiding rehabilitation. However, such a device is rather elaborate, often costly and large in size. Alternatively, one or more weights are attached to the bottom of a platform to provide resistance instead of the supports. The platform is then attached to the foot using straps. One such device is shown in U.S. Pat. No. 5,722,919. This design at least partially addresses the drawbacks cited above. In both of these scenarios, however, the wearer retains proactive control of the movement of the ankle. Consequently, the wearer's neuromuscular system is not compelled to respond to unexpected movements of the ankle.

A more dynamic rehabilitation regime is achieved using wobble boards and rocker boards, which are unstable devices having a rigid (inflexible) flat upper platform on which a wearer stands, and a hemispherical or semicylindrical base, respectively. The wearer stands on the board while trying to prevent it from tipping over. The board's instability places unpredictable demands on the wearer's neuromuscular system thereby providing a more dynamic rehabilitation regime. Rocker boards are sometimes sold in pairs, one for each foot, to specifically target the ankles. However, a pair of wobble or rocker boards cannot accommodate naturalistic movement, particularly flexing of the foot as when walking, running, etc. As a result of this inability to accommodate naturalistic movement, the demands placed on the neuromuscular system, although more dynamic than the demands provided by a device fully under the wearer's control, are dissimilar to those experienced in the "real world", e.g. as when walking on uneven ground for example or abruptly changing direction of movement. Additionally, the limited mobility resulting from the use of a pair of wobble or rocker boards makes for an inconvenient rehabilitation regime.

Applicant has recognized that it is the rigidity/inflexibility of a rocker/wobble board's platform that prevents naturalistic movement. In other words, the platform's rigidity restricts the naturalistic movement of a foot/ankle in that it cannot conform to the natural flexing of a foot. Consequently, any attempt at a natural stride would require the wearer to balance on the front end of one rocker board and the back end of the other in the middle of each stride. Furthermore, because the line along which the foot naturally flexes is at an angle to the hinged mechanism of the knee, the ankle rotates during naturalistic movement. The rigidity of a pair of rocker boards would prevent this rotation, even if such a rocker board were carried by the foot.

A more naturalistic stride might be achieved with a pair of wobble boards. However, the point of balance with a pair of wobble boards is beneath the middle of the user's foot. This is considerably different than the point of balance during naturalistic movement, in which the point of balance shifts between the heel and ball of the foot. Furthermore, because of its hemispherical base a wobble board tends to rock back and forth and twist side to side. In addition, as with a pair of rocker boards, because the platform is rigid and cannot flex to accommodate the natural flexing of a foot, the ankle doesn't rotate as it would during naturalistic movement.

In addition, a wobble board would have to have a very tall base to be sufficiently high to accommodate a user's stride. Otherwise, a user will push off the front edge of the platform and land on the back edge. As consequences of a heightened platform, the point of balance moves further from the naturalistic point of balance, achievement of stability becomes more a matter of general neuromuscular control and conditioning rather than control and conditioning of the muscles around the ankle, and there is a greater the risk of the user overextending their neuromuscular system. A heightened platform could be widened in the lateral direction to reduce the angle of the board should it tip over in a side-to-side directly, thus helping prevent the user from overextending their neuromuscular system. However, this would mean a larger, heavier, and therefore more expensive item to manufacture, store, ship, etc. The increased weight and bulk would also hinder the user's mobility with the device.

SUMMARY

In certain embodiments, a shoe-mountable shoe accessory includes a platform that is free to bend in a manner corresponding to the flexing of the user's foot during walking, running, etc. and a base having a non-planar surface that causes the shoe accessory to be laterally unstable when the base rests on a substantially flat surface with the platform in a substantially horizontal orientation. In one embodiment, the platform is made of a flexible material that permits bending/flexing in an appropriate region corresponding to the foot. In another embodiment, the platform includes rigid sections connected by a hinge that permits bending/flexing in an appropriate region corresponding to the foot. In other embodiments, the shoe-mountable shoe accessory includes a substantially rigid platform that is not specially-configured to bend in a manner corresponding to the flexing of the user's foot during walking, etc. In such embodiments, the non-planar surface of the base is defined primarily by a longitudinally-continuous ridge that is substantially uniform in transverse cross-section between ball and heel portions of a shoe, and that is tapered (has a progressive decreasing transverse cross-sectional area) from the ball portion to the toe portion. The non-planar surface may have a variety of configurations that will provide the desired functionality. Preferably, the base is configured to cause the shoe accessory to be longitudinally stable relative to a flat or substantially flat surface while causing it to be laterally unstable.

The shoe accessory is configured for temporary attachment to a conventional shoe, e.g. with the sole of the shoe resting on the platform, in a non-destructive manner that will not damage the shoe. The platform may be provided with a generally U-shaped heel retainer that is positioned adjacent a rear portion of the platform for receiving a heel of a shoe. The shoe accessory will therefore be carried by and move/flex with the user's shoe, thereby accommodating naturalistic movement, as when the user is walking.

Accordingly, the present invention provides a nondestructive manner for making a flat-soled shoe laterally unstable, yet longitudinally stable, while accommodating a naturalistic stride. Consequently, demands on the nerves and muscles surrounding the ankles are similar to those found in the "real world" as when walking on uneven ground for example or abruptly changing direction, and the present invention provides for a more convenient rehabilitation regime. Consequently, the point of balance of the present invention is close to the naturalistic point of balance so that achievement of stability is primarily a matter of controlling and conditioning the muscles around the ankle. The present invention affords considerable mobility without resorting to a heightened platform and reduces the risk of overextending the user's neuromuscular system without resorting to a lengthened platform. Thus, it can safely accommodate considerable mobility while also exploiting the advantages of being small in size, light in weight, and low in cost.

In addition, because of the elasticity of the strap(s) and the flexibility of the heel retainer used to attach the present invention to a shoe, the present invention can accommodate various shapes, sizes and designs of shoes. Because of this design, the shoe accessory is easy to put on and take off the user's shoes.

BRIEF DESCRIPTION OF THE DRAWINGS

The present invention will now be described by way of example with reference to the following drawings in which.

DETAILED DESCRIPTION

FIGS. 1-5 show an exemplary embodiment of a shoe accessory 10 in accordance with the present invention. The shoe accessory 10 includes a platform 12 having a substantially flat upper surface 14 for supporting a conventional shoe 50, such as a sneaker, in a stable manner relative to the platform 12/shoe accessory 10.

In the embodiment of FIGS. 1-5, the shoe accessory 10 includes a platform 12 that is a unitary body having heel and toe portions 12*a*, 12*b*. The platform 12, or at least a portion thereof, is formed of a semi-rigid material that is capable of flexing to act as a "hinge" in an appropriate location to enable the platform 12 to flex to accommodate the natural flexing of a foot during walking, running, etc. This flexing corresponds to the flexing of a shoe/foot, and is therefore located near the ball of the foot. More specifically this flexing of the foot (and shoe) occurs at a point in time between a pronation stage, in which the foot's arch is flattened as the entire foot (shoe) rests on the ground, and a supination stage in which the foot's (shoe's) heel has left the ground and the foot's (shoe's) toe(s) remain on the ground. An approximate bend line is shown along line AA' of FIG. 2. For example, a molded rubber or other flexible material has been found suitable for this purpose. Virtually any material presently used for making soles of walking/running shoes may be used, as will be appreciated by those skilled in the art.

Figure 1:
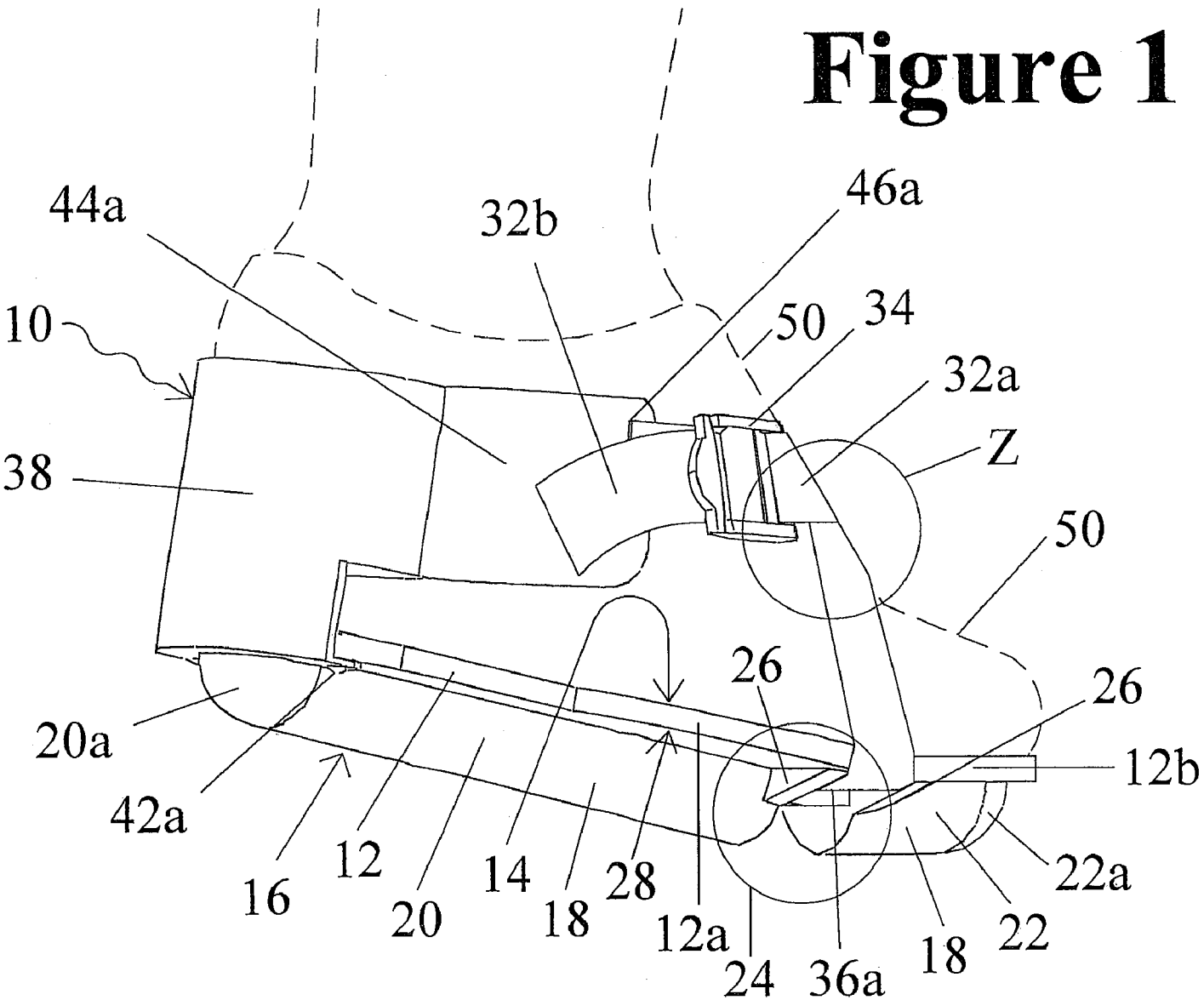
FIG. 1 is a rear perspective view of an exemplary shoe accessory in accordance with a first embodiment of the present invention.
Figure 2:
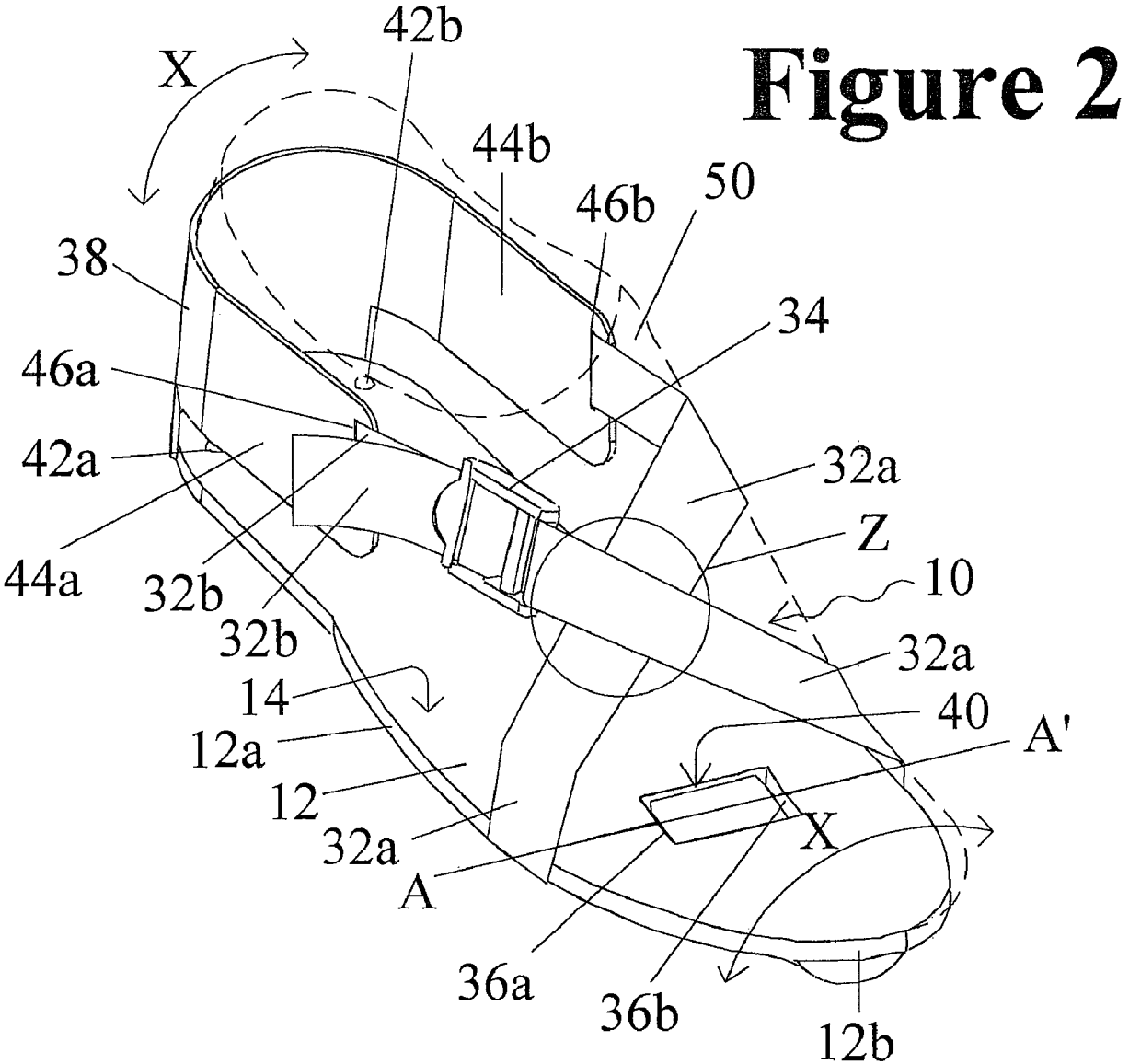
FIG. 2 is a front perspective view of the shoe accessory of FIG. 1.
Figure 3:
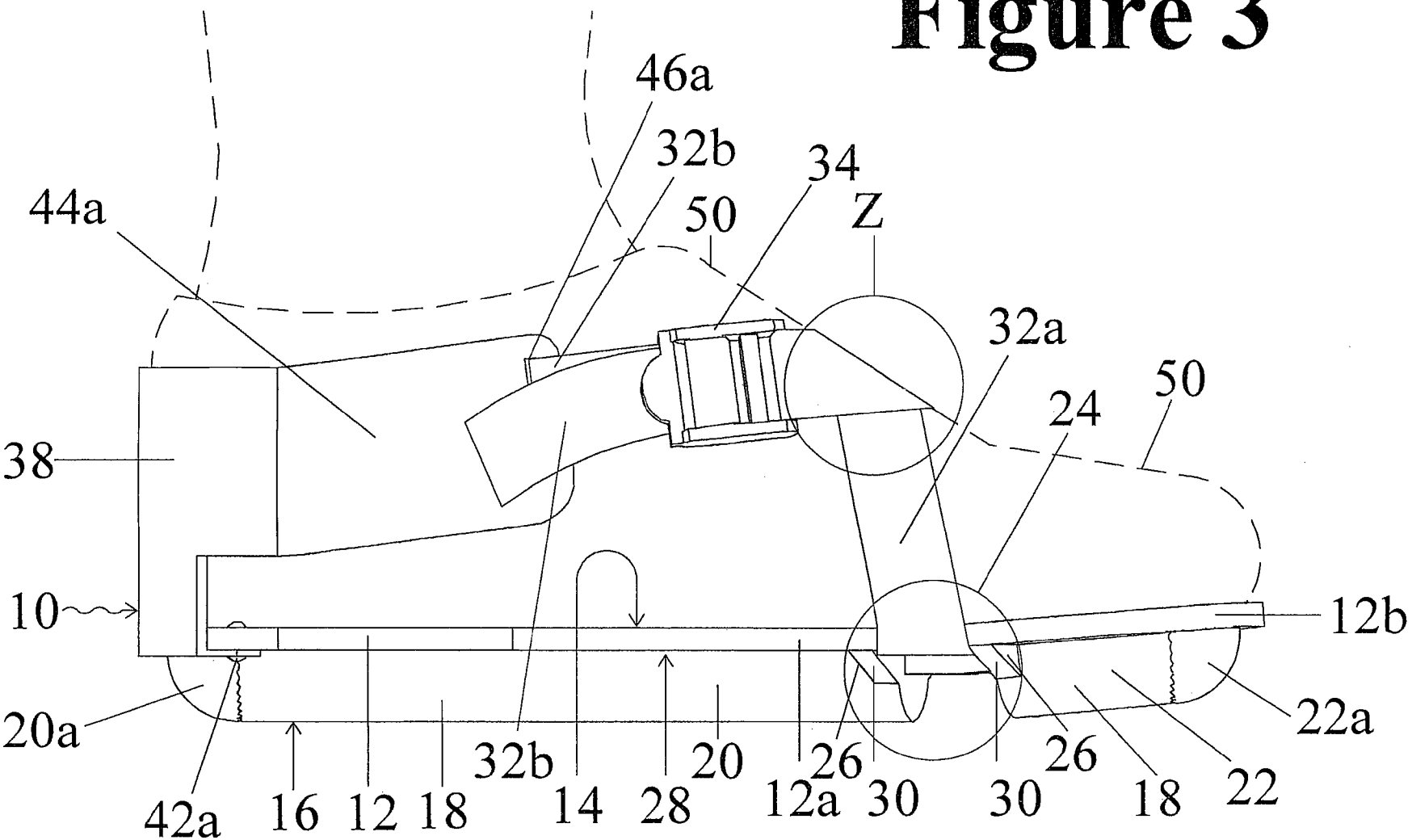
FIG. 3 is a side view of the shoe accessory of FIG. 1.
Figure 4:
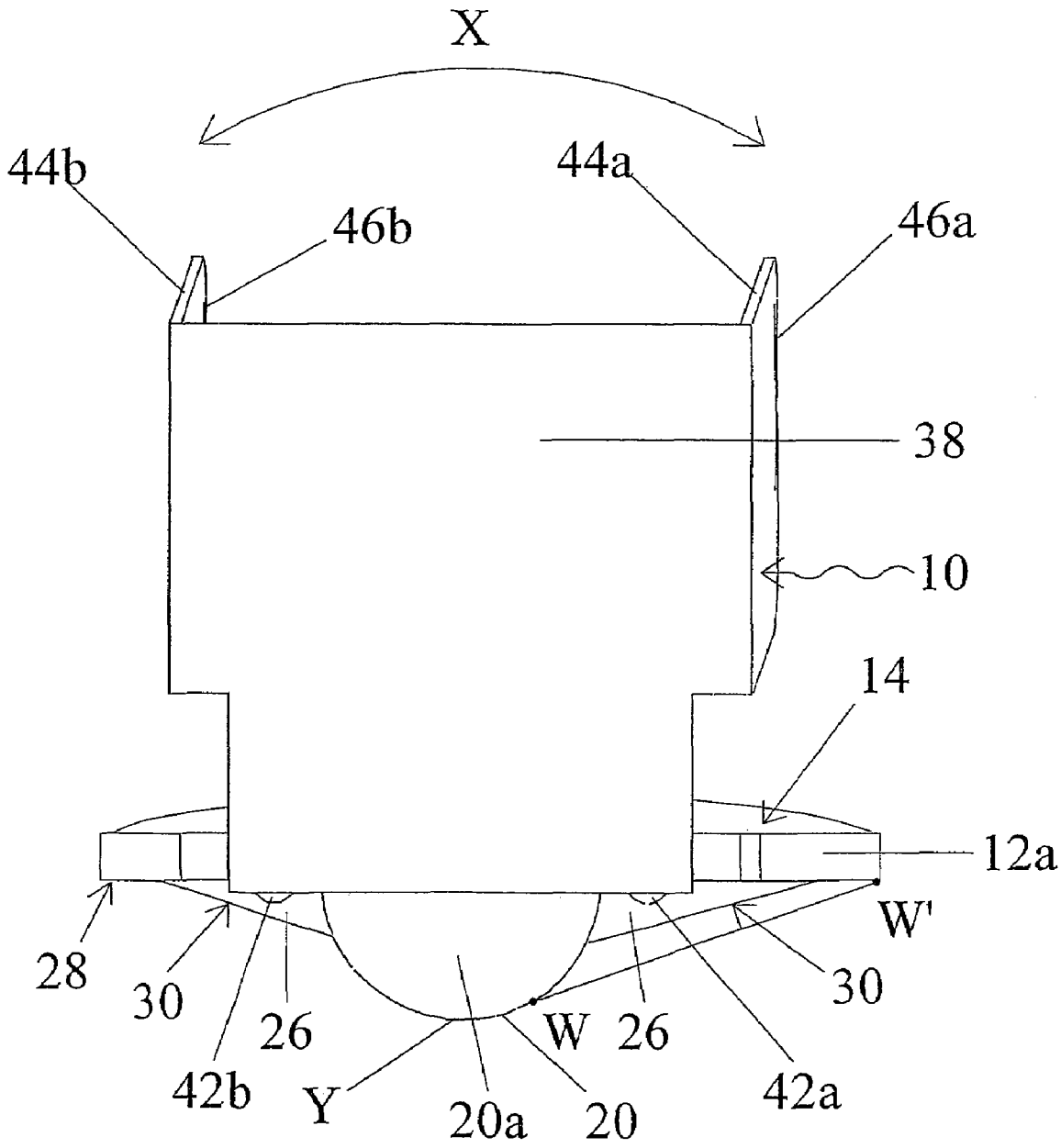
FIG. 4 is a rear view of the shoe accessory of FIG. 1.
Figure 5:
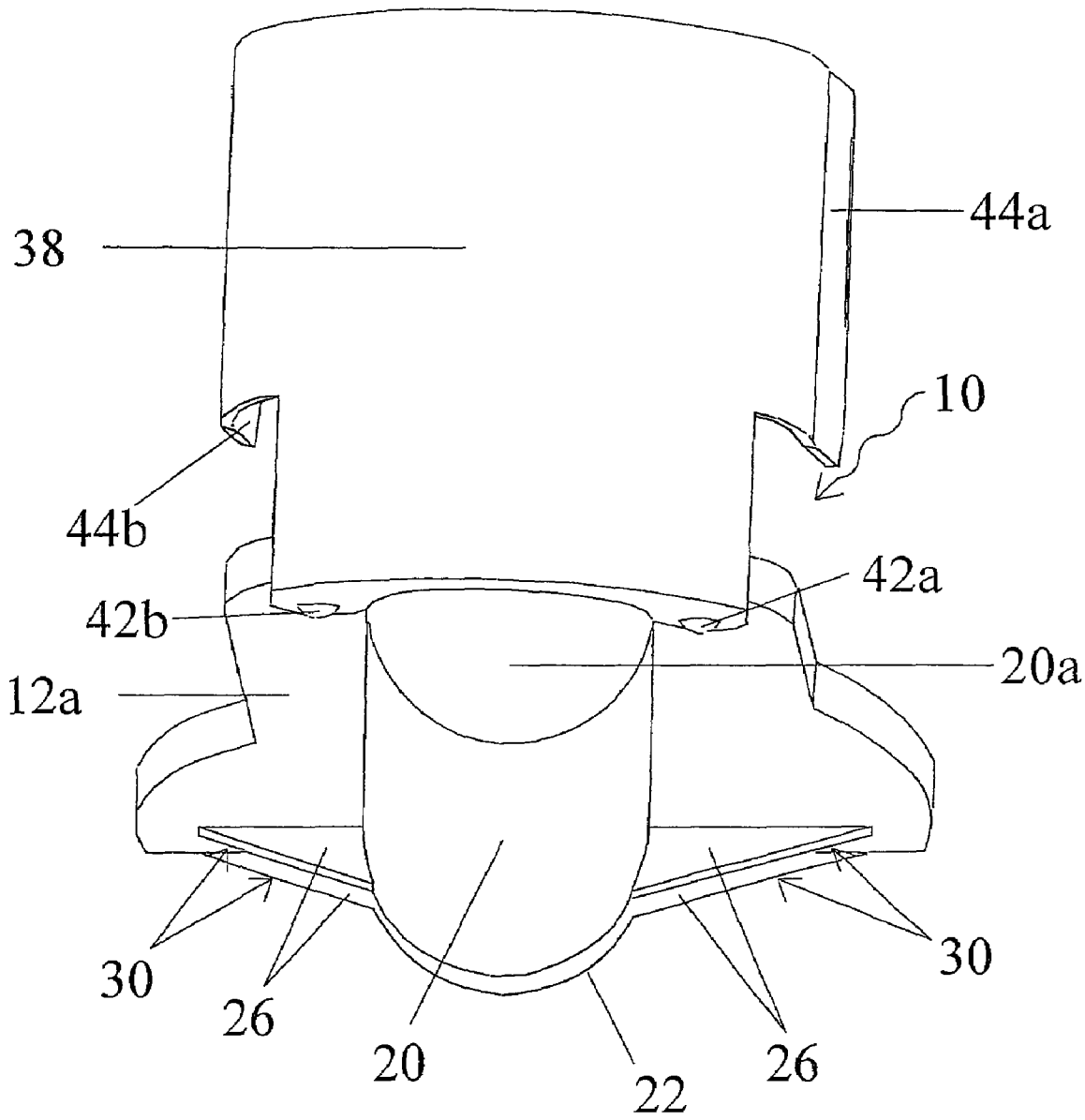
FIG. 5 is a rear view of the shoe accessory of FIG. 1, shown with the platform flexed in mid-step.

The shoe accessory 10 further includes a base 16 including a non-planar surface 18 that causes the shoe accessory 10 to be laterally (see X direction, FIGS. 2 and 4) unstable when the base rests on a substantially flat surface with the platform 12 in a substantially horizontal orientation, as best shown in FIGS. 3 and 4. This is due, at least in part, to the narrow region (see Y, FIG. 4) of the base 16 that will contact the ground during walking, running, etc. Preferably, the non-planar surface 18 is shaped to cause the shoe accessory 10 to be longitudinally stable when the base 16 rests on a substantially flat surface, as best shown in FIG. 3. As a non-limiting example, this may involve providing a non-planar surface 18 that is uniform in cross-section along a substantial portion, e.g. at least half, of its length in the heel-toe (longitudinal) direction. The non-planar surface 18 may have a variety of configurations that will provide the desired functionality. For example, the base 16 may include a ridge that is convex in shape. More specifically, the ridge may include a non-planar surface 18 that has a portion that is generally outwardly curved in the transverse (medial/lateral) direction, and that is elongated in the heel-toe (longitudinal) direction, as best shown in FIGS. 3, 4 and 5. An exemplary semicylindrical ridge is shown in FIGS. 1-5. Alternatively, the ridge may have a non-semicylindrical outward curvature in cross-section (see, e.g. FIG. 8), or may be generally chevron or wedge-shaped in cross-section (not shown).

Preferably the ridge includes a plurality of ridge segments, a first of which (ridge segment 20) extends from a back end of the platform (the heel portion) to just behind a bend line AA' about which the platform will flex under the wearer's body weight during walking, running, etc., and a second of which (ridge segment 22) extends from the front of the platform (the toe portion) to just in front of the bend line AA', as shown in FIG. 2. This leaves a ridge free span 24 to facilitate flexing of the platform in a manner corresponding to natural flexing of the foot, e.g. during walking, running, etc., as shown in FIG. 1, which shows the shoe accessory as flexed/bent during mid-step to accommodate the natural flexing of the foot during walking, running, etc. In one embodiment, the platform has a lesser resistance to flexing in the area of the ridge free span 24 to promote proper flexing of the platform. For example, this may be achieved by forming most of the platform from a relatively rigid material and using a less rigid material in the area of the ridge free span 24 region, or using a single material to form the entire platform 12 but also providing a reduced thickness portion of the platform at the ridge free span 24 region. Alternatively, the platform may have a greater resistance to flexing in the area of the free ridge upon 24 by providing a more rigid material in that area or by providing an increased thickness portion in that area.

In certain embodiments, the ends 20*a*, 22*a* of the ridge segments 20, 22 have longitudinally curved surfaces for engaging the ground in mid-step as the ridges begin to engage in mid-step, as best shown in FIG. 1. In the example of semicylindrical ridge segments 20, 22, the ends 20*a*, 22*a* may be quarter spherical, as shown in FIGS. 1-7, or simply longitudinally curved, as in FIG. 8. This enables the ridge segments 20, 22 to "roll" forward (or backward) as they engage the ground or begin to leave the ground, thus leading to a smoother stride.

Figure 8:
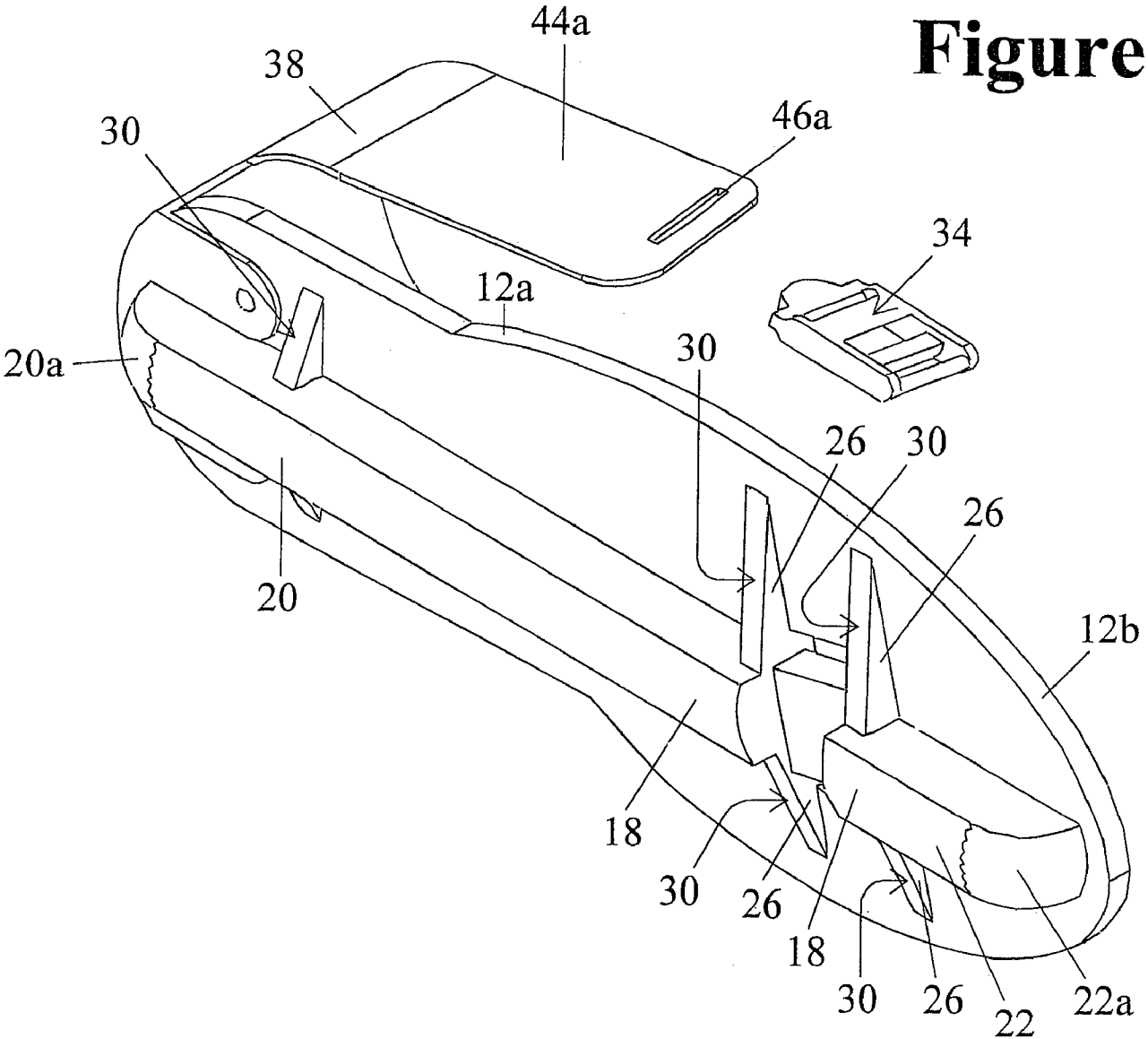
FIG. 8 is a bottom perspective view of another exemplary embodiment of the shoe accessory of FIGS. 1-5.

In the exemplary embodiments shown in FIGS. 1-5 and 8, the platform 12 includes not only ridge segments 20, 22, but also support members 26 extending laterally of the platform 12. Each support member 26 abuts both one of the ridge segments 20, 22, and the bottom side 28 of the platform 12. Each support member 26 is configured such that its lower edge 30 does not extend beyond a line having a first endpoint (W') at an outer edge of the platform 12, and a second endpoint (W) at a point of contact of the ridge segment 20, 22 with the ground, as best shown in FIGS. 2 and 4. In this manner, each support member 26 will not interfere with movements of the laterally unstable platform 12 on relatively flat ground, and lateral rocking motion of the platform 12 about a ridge segment 20, 22 will be constrained only by the structure of the platform 12 and base 16, and not by the support members 26. Further, the support members 26 provide an additional measure of lateral rigidity to the shoe accessory without compromising longitudinal flexibility. Consequently, lateral shifts in weight during use do not result in excessive lateral flexing of the shoe accessory 10. Rather, such shifts in weight result primarily in lateral rocking motion of the shoe accessory 10 about the ridge segments 20, 22, as generally shown in direction X of FIGS. 2 and 4. In a preferred embodiment, the support members 26 are positioned on opposite sides of the strap 32 to define a channel therebetween for passage and constraint of the strap 32, as best shown in FIGS. 1, 3 and 8.

Figure 6:
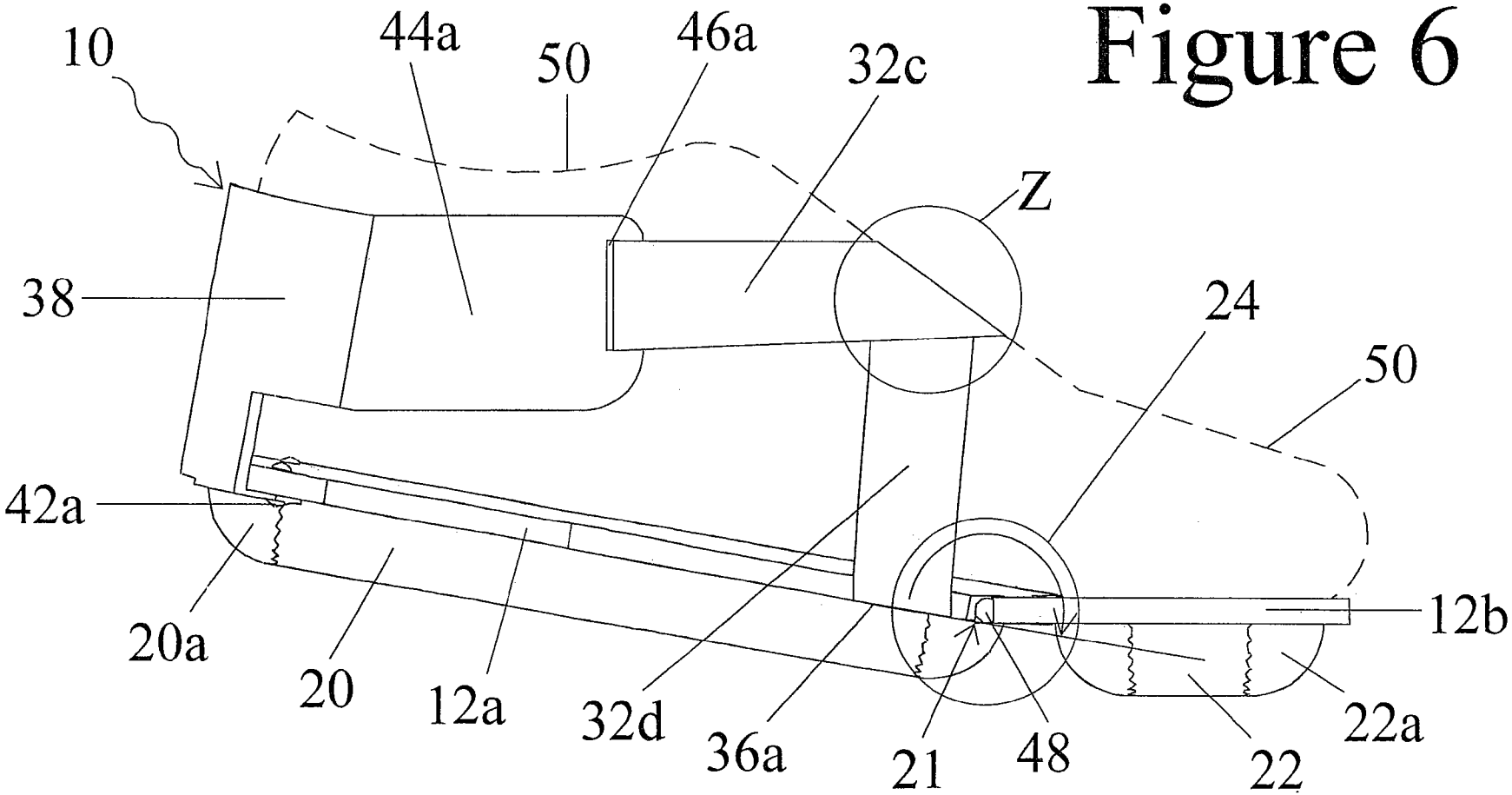
FIG. 6 is a side perspective view of an exemplary alternative embodiment of the shoe accessory of FIGS. 1-5.
Figure 7:
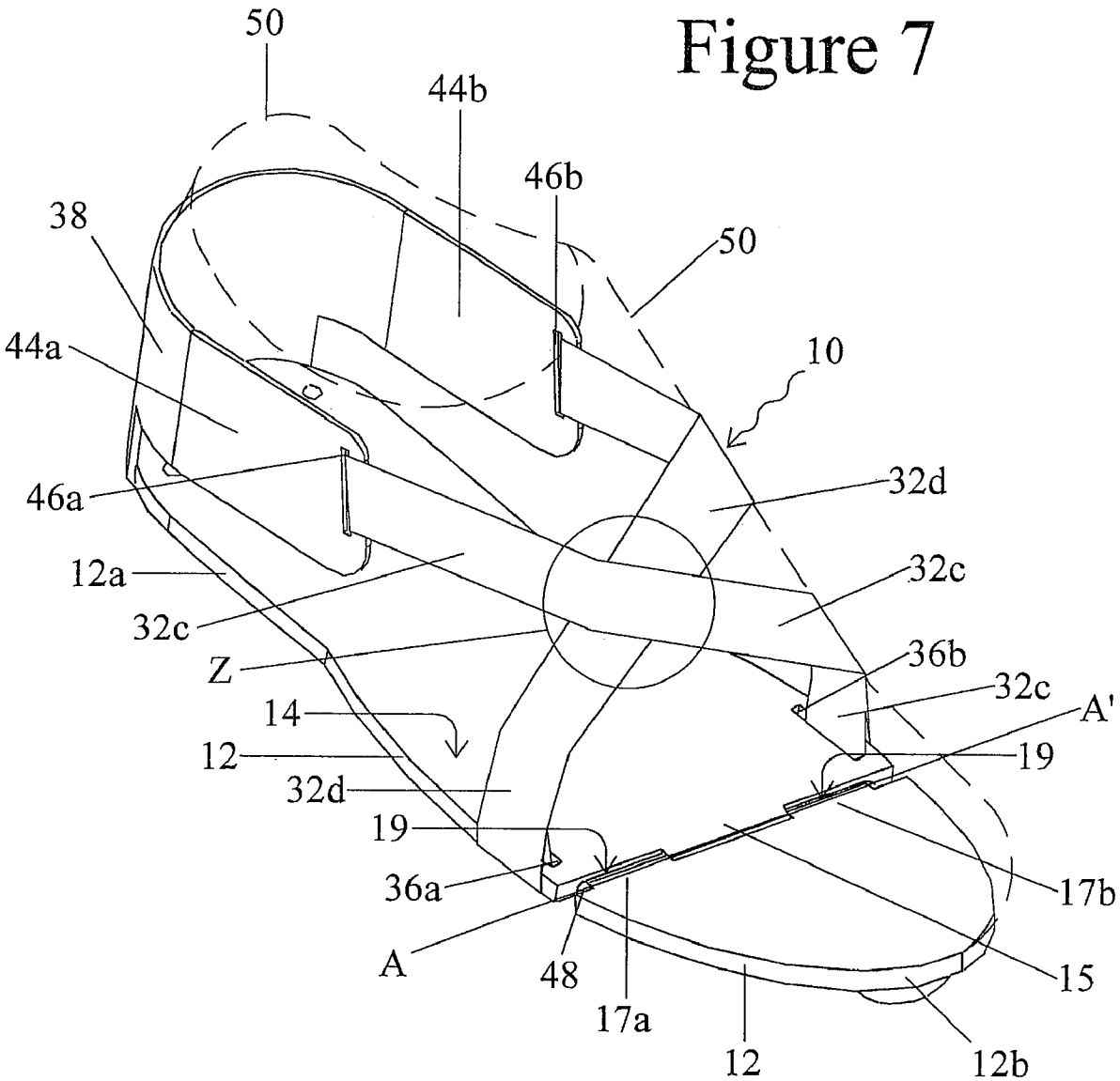
FIG. 7 is a front perspective view of the shoe accessory of FIG. 6.

The shoe accessory 10 is configured for temporary attachment to a conventional shoe 50, e.g. with the sole of the shoe resting on the upper surface 14 of the platform 12, in a non-destructive manner that will not damage the shoe 50. By way of example, the shoe accessory 10 may be provided with a strap 32 including one or more strap segments 32*a* and 32*b*. In one embodiment, the strap 32 is made of elastic webbing, and the ends of the strap are fixed to the structure of the shoe accessory as best shown in FIGS. 6 and 7. In an alternative embodiment, as shown in FIGS. 1-5, the strap's strap segments 32*a*, 32*b* are made of relatively inelastic webbing and an adjustable fastener is used to secure the straps around the shoe. An exemplary adjustable fastener is the ladderlock buckle 34 that is shown in FIGS. 1, 2, 3 and 8.

The platform 12 may be provided with a slot 36*a*, 36*b* on each side of its toe segment 12*b*, and the strap is threaded through the slots. In one embodiment, the slots extend through the platform's thickness, and the straps are threaded through the platform's thickness, and thus a segment of the strap lies atop the platform. The straps ends extend back from the start in a crossing pattern, as shown at in FIGS. 1 and 2. The ends of the strap are attached to a heel retainer 38, as discussed further below. In one embodiment the strap is a unitary member and the elasticity of the strap allows for secure attachment to a variety of shoes of various sizes and configurations. In an alternative embodiment, the strap includes a first strap segment 32*a* that is fixed on one side of the heel retainer and terminates at the buckle 34, and a second strap segment 32*b* is fixed to the opposing side of the heel retainer, such that the strap segments 32*a*, 32*b* and buckle 34 are adjustably fastenable to accommodate feet/shoes of various sizes, as best shown in FIG. 2. In this embodiment, the strap segments may be relatively inelastic.

In a certain embodiment, as shown in FIG. 2, the platform includes a portion 40 that is recessed from the surrounding surface portion 14 of the platform 12. This recessed portion 40, and the corresponding position of the slots 36*a*, 36*b* allow the strap to follow a flat path along at least a substantial portion of the width of the platform 12, thereby reducing stress on the platform 12 in the vicinity of the slots 36*a*, 36*b*, as best shown in FIGS. 2 and 3. Further, the recessed portion 40 permits the strap(s) to lie beneath the plane of the upper surface 14 of the platform 12, thereby reducing wear on the strap caused by the wearer's shoe.

As best shown in FIGS. 1 and 2, the shoe accessory 10 may be provided with a heel retainer 38 for limiting longitudinal movement of the shoe 50 relative to the platform 12. For this purpose, the heel retainer 38 is positioned adjacent to the heel end of the platform 12 and has a rigid central section that is preferably generally U-shaped for abutting a rearmost portion of the heel of the shoe, e.g., to cup and brace the heel portion of the shoe 50. The heel retainer 38 is joined to the platform 12 (or heel segment thereof adjacent to its back end and extends above the top surface of the platform 12, as shown in FIGS. 1 and 2. For example, the heel retainer 38 may be integrally formed with the platform, e.g. via injection molding the heel retainer 38 and the platform 12 as a unitary body. Alternatively the heel retainer 38 may be a discrete member mechanically, adhesively, or otherwise fastened to the platform 12. In the exemplary embodiments of FIGS. 1-5 and 6-7, the heel retainer 38 is mechanically joined to the platform 12 by rivets 42*a*, 42*b*. The heel retainer 38 is preferably substantially rigid to allow for secure fastening of the shoe accessory 10 to the shoe 50, and for supporting the shoe's heel.

The heel retainer 38 may also include flexible side portions 44*a*, 44*b* that are capable of bending around and laterally embracing the heel of the shoe 50, as best shown in FIGS. 5 and 8. In this manner, the flexible side portions 44*a*, 44*b* are resiliently adjustable, and thus further improve the shoe accessory's adaptability to a variety of shoes of various sizes and configurations. It should be noted that while these side portions are laterally flexible, they are vertically rigid, thereby further anchoring the accessory to the shoe. The side portions 44*a*, 44*b* may include slots 46*a*, 46*b*, as described above, to which the strap segments 32*a*, 32*b* are secured to allow for easy adjustment of the side portions 44*a*, 44*b* by adjustment of the strap(s) For example, the strap 32 or strap segments 32*a*, 32*b* may be secured to the side portions 44*a*, 44*b* by threading the ends of the strap/strap segments 32, 32*a*, 32*b* through a corresponding slot 46*a*, 46*b* and folding the respective end back and attaching it to a portion of the strap/strap members not threaded through the slots 46*a*, 46*b* via stitching, rivets, glue, etc. Alternatively the ends of the strap/strap members could be attached directly to the side portions 44*a*, 44*b* via stitching, rivets, glue, etc., in which case the slots 46*a*, 46*b* could be used to provide additional anchorage, by threading the ends through the slots and folding them back before attaching them directly to the extensions, or eliminated altogether.

The shoe accessory 10 is attachable, in a non-destructive manner, to a conventional, relatively flat-soled shoe 50 worn by a wearer. More particularly, the shoe 50 worn by the wearer may be inserted between the strap/strap segments 32, 32*a*, 32*b*, heel retainer 38 and platform 12, under the "X" formed by the strap/strap members, as shown at Z in FIGS. 1 and 2. Fixed elastic strap/strap members may be stretched to admit passage of the shoe 50, until the shoe 50 seats securely against the platform 12, at which time the strap/strap segments 32, 32*a*, 32*b* may be allowed to contract or be otherwise secured to secure the shoe accessory 10 to the shoe 50.

Adjustable inelastic strap segments 32*a*, 32*b* may be secured with the buckle 34, etc. to secure the shoe accessory 10 to a shoe 50 in a corresponding manner. The adjustment of the strap segments 32*a*, 32*b* will cause the side portions 44*a*, 44*b* to securely engage and help retain the shoe 50, with the shoe's heel positioned in the heel retainer 38. Because of the elasticity or adjustability of the strap/strap segments 32, 32*a*, 32*b* and the flexibility of the side portions 44*a*, 44*b* on both sides of the heel retainer 38, the shoe accessory 10 can accommodate the shape and design of a variety of shoes.

After a shoe accessory 10 has been attached to each of the wearer's shoes 50, the wearer can move about, by walking, running, etc. As the wearer does so, the platform 12 flexes, in the vicinity of the ridge free span 24 and generally about line AA' of FIG. 2, in concert with the flexing of the wearer's foot and shoe during the transition from pronation to supination. The rearward ridge segment 20 and/or the forward ridge segment 22, depending on the phase of the stride, make the platform 12 and consequently the shoe accessory 10 and shoe 50 laterally unstable (i.e. permitting movement generally in the X direction as shown in FIGS. 2 and 4), thus providing a therapeutic effect. Consequently the wearer may walk, run, etc. in a conventional manner, causing the foot and/or ankle joint to move in a naturalistic manner while the wearer's shoes are made to be laterally unstable, even on a substantially flat surface. The wearer's muscles will attempt to stabilize the foot/shoe, thereby exercising, strengthening, and rehabilitating the wearer's ankle and surrounding foot/leg musculature during simple walking, running, etc. on a flat or substantially flat surface. This exercise tends to strengthen muscles that prevent inversion or eversion of the ankle that is characteristic of ankle sprains or other injuries. So it should be noted however, that the shoe accessory 10 and shoe 50 remain stable or relatively stable in a longitudinal (heel/toe) direction. It is believed that this is due, at least in part, to the surfaces of the ridge segments 20, 22 which are flat or relatively flat in the longitudinal (heel/toe) direction, and which are elongated to span a major portion (e.g. greater than 50%, or greater than 75%, of the length of the shoe accessory's platform).

FIGS. 6 and 7 show an alternative embodiment, in which the shoe accessory's platform 12 includes at least two discrete rigid segments 12*a*, 12*b* that are mechanically hinged in an appropriate location (see line AA' in FIG. 7) to enable the platform 12 to "flex" to accommodate the natural flexing of a foot during walking, running, etc. For example, a variety of plastic materials and metal materials have been found suitable for this purpose. More particularly, the heel segment 12*a* of the platform 12 includes a centrally located knuckle 15, and the toe segment 12*b* of the platform 12 has a pair of corresponding spaced knuckles 17*a*, 17*b*. The knuckles 15, 17*a*, 17*b* define openings therethrough and are alignable to form a hinge barrel such that a hinge pin 48 may be passed therethrough to mechanically couple the heel and toe platform segments 12*a*, 12*b* in a hinged manner. In a preferred embodiment, the top portions 19 of the knuckles 15, 17*a*, 17*b* are rounded to permit the segments 12*a*, 12*b* to rotate relative to one another to correspond to natural flexing of the foot, while the lower portions 21 of the knuckles 15, 17*a*, 17*b* are squared off to cause an interference between the knuckles and/or the platform 12 that prevents the hinged segments 12*a*, 12*b* from rotating relative to one another to form an angle that would not correspond to the natural flexing of a foot (see FIGS. 6 and 7). This configuration also prevents the toe segment 12*b* of the platform from falling down and away from the shoe 50 when the wearer's foot is lifted from engagement with the ground.

In the alternative embodiment of FIGS. 6 and 7, two separate fixed straps 32*c*, 32*d* are employed. The two straps 32*c*, 32*d* are arranged in a crossing pattern, as shown at Z in FIG. 6, similar to that used in the embodiment shown in FIGS. 1 and 2, but rather than being threaded through slots 36*a*, 36*b* they are fixed to the slots, e.g. by threading the ends of straps 32*c* and 32*d* through slots 36*a* and 36*b*, respectively. The ends are then folded back and fixed to the portions of the strap not threaded through slots 36*a*, 36*b* via stitching, rivets, glue, etc. Alternatively, the ends of straps 32*c* and 32*d* could be attached, via stitching, rivets, glue, etc. directly to the heel 12*a* segment of the platform, the attachment points being in the vicinity of slots 36*a* and 36*b*, respectively. The opposite ends of the straps 32*c*, 32*d* are fixed to the side portions 44*a*, 44*b* of the heel retainer 38 as described above. The slots may be retained to provide additional anchorage, by threading the ends through the slots and folding them back before fixing them directly to the side portions, 44*a*, 44*b* of the heel retainer, or eliminated altogether.

The alternative embodiment of the shoe accessory 10 that is shown in FIGS. 6 and 7 is attached to the wearer's shoe 50 in a manner similar to that described above. As in the preferred embodiment, the platform 12 "flexes" in concert with the wearer's foot and shoe 50 by pivoting of the platform's segments 12*a*, 12*b* about the hinge line AA'.

Figure 9:
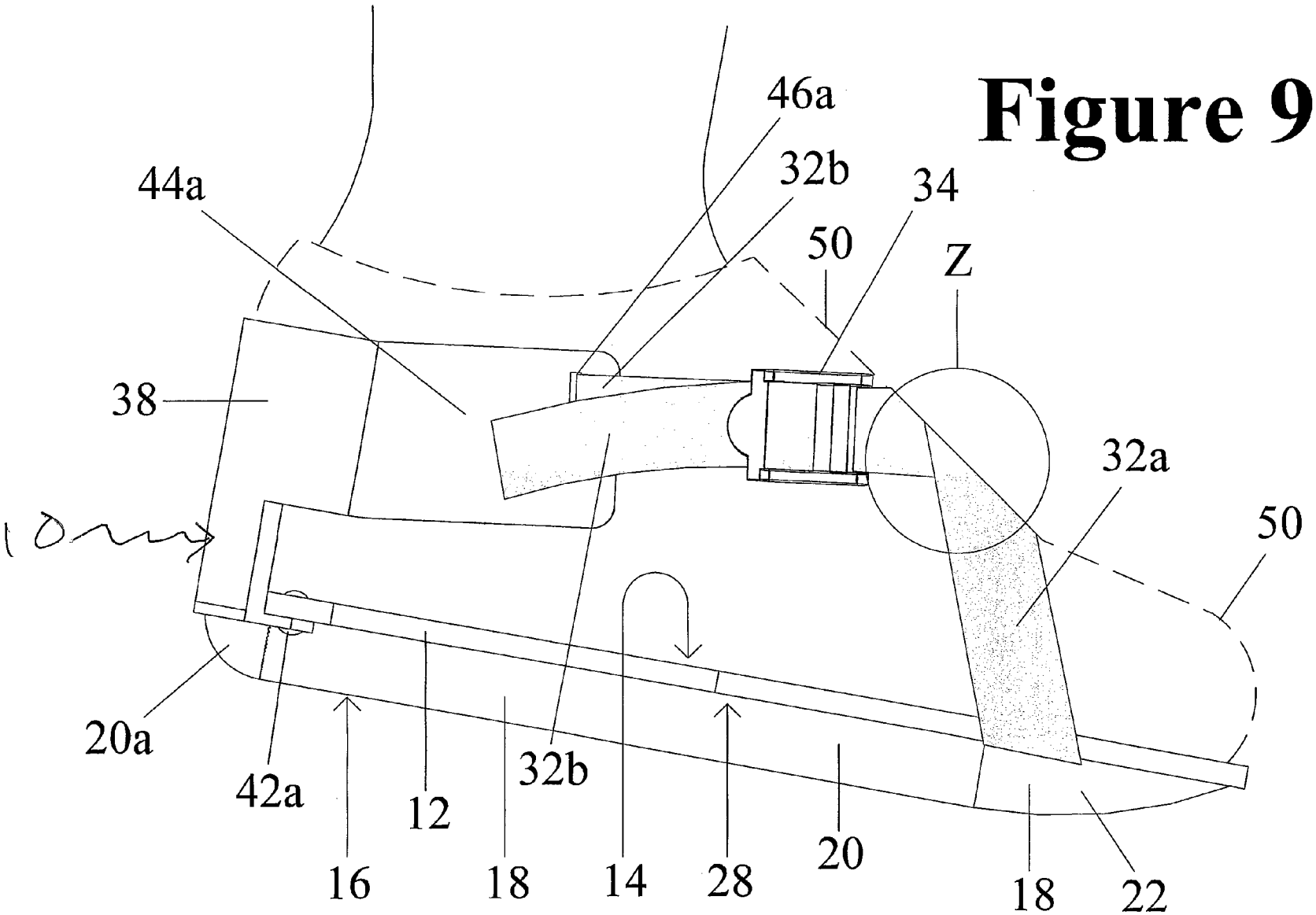
FIG. 9 is a side view of an alternative embodiment of the shoe-accessory.
Figure 10:
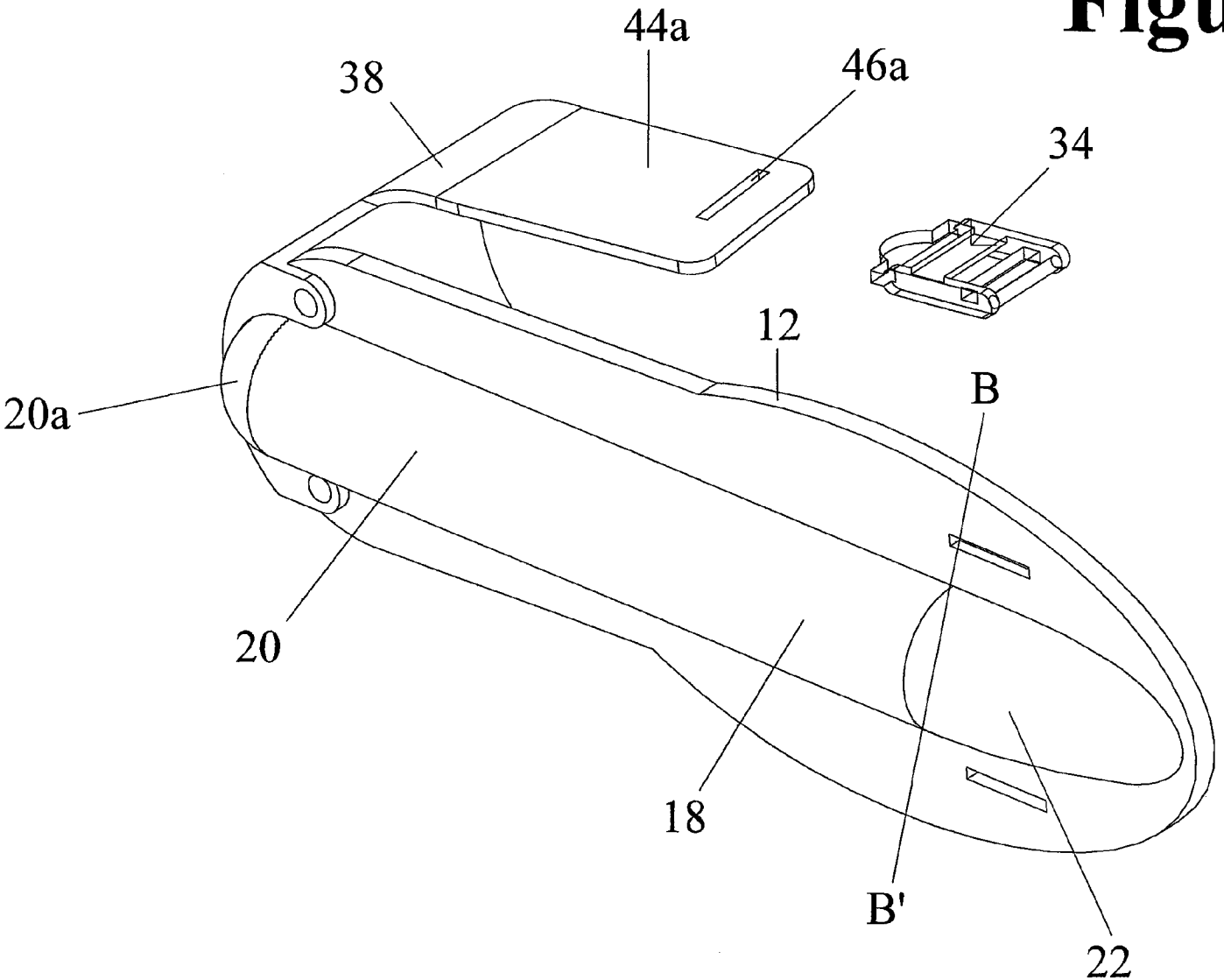
FIG. 10 is a bottom perspective view of the embodiment of FIG. 9 (with the strap omitted for illustrative clarity)
Figure 11:
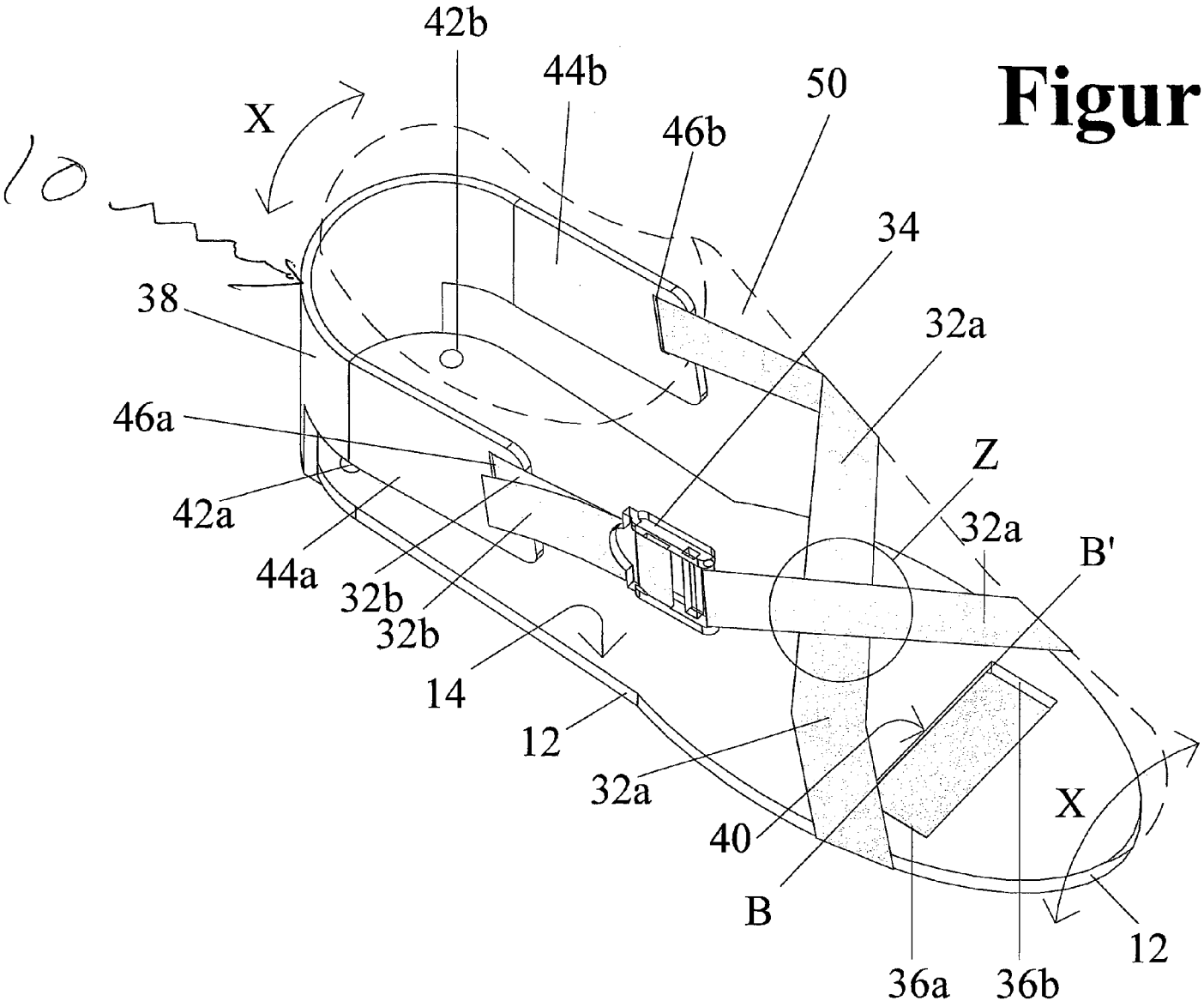
FIG. 11 is a front perspective view of the embodiment of FIG. 9.

The alternative embodiment of FIGS. 9-11 is generally similar to those described above with reference to FIGS. 1-8. Of particular note in the embodiment of FIGS. 9-11 is that that the platform 12 may be rigid or substantially rigid, and is not specially configured to promote bending adjacent the ball portion of the foot during use. Instead, in this embodiment, the shoe accessory 10 includes a specially-configured ridge that accommodates a natural gait. More specifically, the base 16 includes a ridge including rearward and forward ridge portions 20, 22 (numbered similarly as in the embodiments referenced above for similar, but not identical, elements). In this embodiment, the ridge is longitudinally continuous, as best shown in FIGS. 9 and 10. The rearward and forward ridge portions 20, 22 meet at a location corresponding to an approximate location of the ball of wearer's foot when the shoe accessory is worn. This location is denoted by line B-B' in FIGS. 10 and 11. The rearward portion 20 of the ridge is substantially uniform in transverse cross-section (e.g., semi-circular or otherwise generally convex), as best shown in FIGS. 9 and 10. The forward portion 22 of the ridge is tapered from the ball region toward the toe region. Accordingly, the forward portion 22 of the ridge has a progressively decreasing transverse cross-sectional area from the ball portion to the toe/leading portion, as best shown in FIGS. 9 and 10. For example, the cross-section of the forward portion 22 may be semi-circular or otherwise generally convex. In use, as the wearer shifts his/her weight from the rearward portion 20 to the forward potion 22, the shoe accessory rocks forward, with the rearward portion 20 leaving the ground, at least partially, and the shoe accessory engaging the ground primarily along the forward portion 22. This allows for a natural gait similar to that facilitated by the embodiments including a flexible or segmented platform.

Optionally, a pair of shoe accessories 10 may be sold together, e.g. in a single package, to provide an exercise kit. In one such embodiment, the platforms 12 of the shoe accessories 10 are identical. In an alternative embodiment, one of the shoe accessories has a platform 12 contoured to support the sole of a left shoe (i.e. contoured similarly to the sole of a shoe designed to fit a person's left foot), and the other of the shoe accessories has a platform 12 contoured to support the sole of a right shoe.

Accordingly, the present invention provides a nondestructive means for making a flat soled shoe laterally unstable while allowing for longitudinally stability and a naturalistic gait.

Having thus described particular embodiments of the invention, various alterations, modifications, and improvements will readily occur to those skilled in the art. As non-limiting examples, more than one hinge could be employed to facilitate bending of the platform. Various methods of attachment are also possible. For instance, the shoe accessory could be attached to the wearer's shoe with two straps, one over the fore foot and one over the mid foot, with a heel retainer around the heel to prevent the accessory from sliding forward. Such alterations, modifications and improvements as are made obvious by this disclosure are intended to be part of this description though not expressly stated herein, and are intended to be within the spirit and scope of the invention. Accordingly, the foregoing description is by way of example only, and not limiting.

What is claimed is:

1. A shoe accessory configured for temporary mounting to a shoe, the shoe accessory comprising:

a rigid, unitary platform having a top side for supporting a sole of the shoe, a bottom side opposite said top side, a toe portion and a heel portion;

a protruding ridge disposed on said bottom side of said platform, said ridge providing a non-planar base of said shoe accessory, said ridge extending longitudinally of said platform and continuously from said heel portion to said toe portion, said ridge comprising:

a rearward portion extending from said heel portion to a ball portion of said platform intermediate said heel portion and said toe portion, said rearward portion being uniform in transverse cross-section and having an outer surface that is convex in a lateral direction transverse to said longitudinal direction; and a forward portion extending from said ball portion to said toe portion, said forward portion being tapered to have a progressively decreasing transverse cross-sectional area from said ball portion to said toe portion;

a strap attached to said platform, said strap being capable of securing said shoe accessory to the shoe; and a heel retainer joined to said platform, said heel retainer extending above said top surface of said platform.

2. The shoe accessory of claim 1, further comprising a heel retainer joined to said platform proximate said heel portion of said platform, said heel retainer extending above said top surface of said platform.

3. The shoe accessory of claim 2, wherein said heel retainer is shaped to receive a heel of the shoe.

4. The shoe accessory of claim 3, wherein said heel retainer includes a rigid central section for abutting a rearmost portion of said heel of the shoe, and a pair of opposed side portions extending from said heel portion toward said toe portion, said side portions being flexible relative to said central section, said side portions being capable of bending around and laterally embracing said heel of the shoe.

5. The shoe accessory of claim 4, wherein said strap is attached to at least one of said pair of opposed side portions.

6. The shoe accessory of claim 1, wherein said strap includes multiple discrete strap segments.

7. The shoe accessory of claim 6, further comprising a fastener joined to at least one of said strap segments and capable of selectively securing said strap segments to each other to secure the shoe to said platform.

8. The shoe accessory of claim 6, wherein said strap segments are positioned relative to said platform in a manner in which a portion of said strap segments overlap.

9. The shoe accessory of claim 1, wherein said ridge is chevron-shaped in cross-section.

10. The shoe accessory of claim 1, wherein said ridge is convex in cross-section.

11. The shoe accessory of claim 10, wherein said ridge is semi-circular in cross-section.

12. The shoe accessory of claim 1, further comprising at least one support member extending laterally of said platform, said support member abutting both a portion of said ridge and said bottom side of said platform.

13. An exercise kit comprising:

a pair of shoe accessories, each shoe accessory comprising:

a rigid, unitary platform having a top side for supporting a sole of the shoe, a bottom side opposite said top side, a toe portion and a heel portion;

a protruding ridge disposed on said bottom side of said platform, said ridge providing a non-planar base of said shoe accessory, said ridge extending longitudinally of said platform and continuously from said heel portion to said toe portion, said ridge comprising:

a rearward portion extending from said heel portion to a ball portion of said platform intermediate said heel portion and said toe portion, said rearward portion being uniform in transverse cross-section and having an outer surface that is convex in a lateral direction transverse to said longitudinal direction; and a forward portion extending from said ball portion to said toe portion, said forward portion being tapered to have a progressively decreasing transverse cross-sectional area from said ball portion to said toe portion;

a strap attached to said platform, said strap being capable of securing said shoe accessory to the shoe; and a heel retainer joined to said platform, said heel retainer extending above said top surface of said platform.

14. The kit of claim 13, wherein one of said pair of shoe accessories has a platform contoured to support the sole of a left shoe, and the other of said pair of shoe accessories has a platform contoured to support the sole of a right shoe.

* * * * *